United States Patent [19]

Consiglio, Jr.

[11] 3,952,872

[45] Apr. 27, 1976

[54] PACKAGE FOR CARDED MERCHANDISE

[76] Inventor: Peter A. Consiglio, Jr., c/o Parker Metal Corp., 85 Prescott St., Worcester, Mass. 01601

[22] Filed: Nov. 18, 1974

[21] Appl. No.: 524,496

[52] U.S. Cl. ..... 206/526; 206/806; 229/44 R

[51] Int. Cl.[2] ..... B65D 5/66; B65D 85/54

[58] Field of Search ..... 206/44.12, 45.12, 282, 206/292, 296–299, 459, 461, 491, 526, 806; 229/7 R, 38, 44 R

[56] References Cited

UNITED STATES PATENTS

| | | | |
|---|---|---|---|
| 2,504,179 | 4/1950 | Chemlinski | 229/44 R |
| 2,770,357 | 11/1956 | Sheard | 229/44 R X |
| 3,148,770 | 9/1964 | Cosman | 206/526 |
| 3,187,889 | 6/1965 | Sinclair | 206/461 |
| 3,262,631 | 7/1966 | Belsinger | 206/299 X |
| 3,313,407 | 4/1967 | Palm, Jr. | 206/491 |
| 3,369,652 | 2/1968 | Bebout | 206/299 X |

*Primary Examiner*—George E. Lowrance
*Attorney, Agent, or Firm*—Charles R. Fay

[57] ABSTRACT

A package for carded merchandise comprising a box having an open top and a hinged lid for a series of cards in the box, each card having a hanger aperture aligned adjacent the top of the box with openings in the front and rear walls of the box to allow the hanger to be inserted through the cards with the lid closed. The lid is hinged at one side of the box, the openings in the walls being adjacent to said lid and intersecting the side wall of the box upon which the lid is hinged, the lid including a portion of the side wall of the box.

2 Claims, 2 Drawing Figures

PACKAGE FOR CARDED MERCHANDISE

BACKGROUND OF THE INVENTION

Attention is directed to copending application Ser. No. 457,587, filed Apr. 3, 1974, and now abandoned, the present case being an improvement thereon. The background of the present invention is substantially the same as that described in the identified application but in the present case the box is improved because it is easier to apply the price detail, etc., to the cards while in the box, and the side of the box which exposes the portions of the cards to which the price information is to be applied is made stronger and the construction is such as to allow the price to be applied easier and faster.

SUMMARY OF THE INVENTION

A box is provided which has a bottom, side walls, front and rear walls, and a hinged lid for closing the open top thereof. Merchandise cards with hanger holes are arranged in the box and the hanger holes are aligned to receive the hanger while the cards are in the box and the lid is closed by reason of the fact that the front and rear walls of the box are provided with relatively large openings that intersect the top edges of the walls and the adjacent side wall.

The lid comprises a portion of the side wall adjacent to the openings in the walls, and the openings take up more than a half of the width of the walls in which they are located. A portion of the lid comprises also a portion of the side wall and is pivoted at the bottom areas of the wall openings being then folded over to form the lid per se, whereby the side wall adjacent to the wall openings is strengthened by the presence of the lid, and also by reason of the fact that the fixed portion of the side wall is shorter than the opposite side wall so that when the price information is affixed to the cards one after the other with the lip open, the side wall upon which the lid is mounted is considerably stronger and does not tend to sag outwardly.

PREFERRED EMBODIMENT OF THE INVENTION

Figure 1:
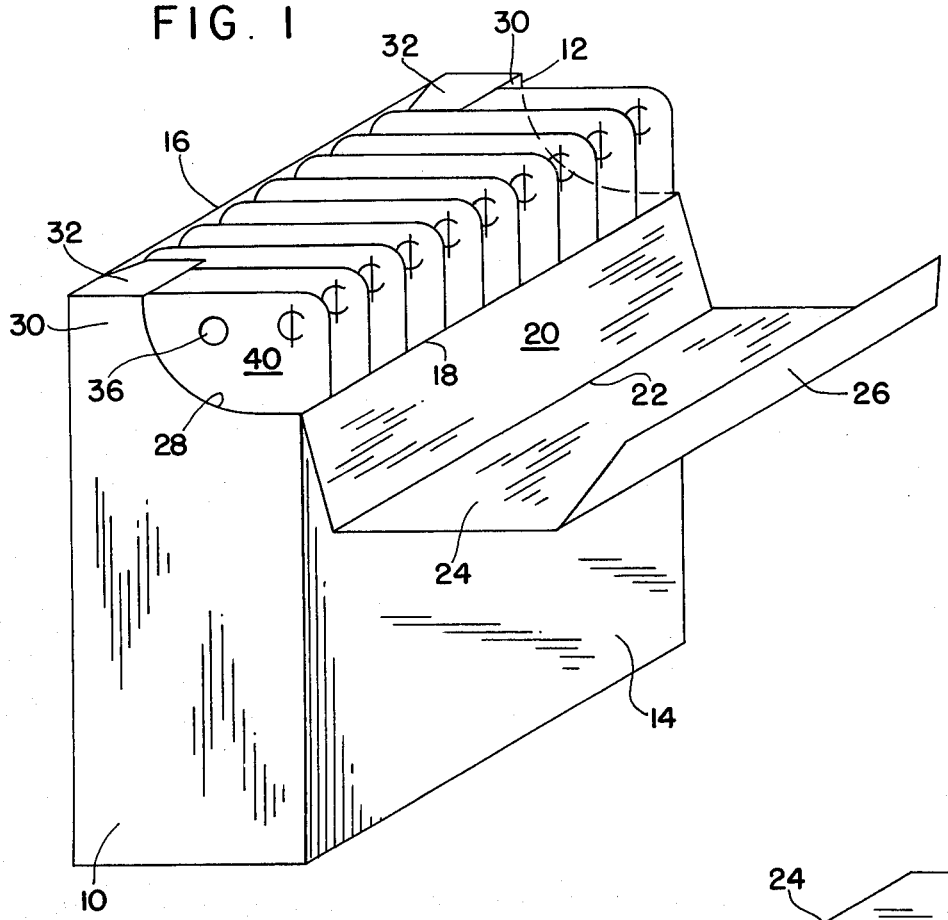
FIG. 1 is a perspective view showing the package open.

A box of any suitable material is provided with front wall 10, rear wall 12, side wall 14, and an opposite side wall 16. This box also has a closed bottom.

Side wall 14 is provided along a line 18 with a hinge which may be simply a fold in the side wall 14, and this hinge carries a side wall member 20 which is provided in turn with a hinge 22 carrying a lid portion 24 having an end flap 26. Fold 18 is parallel to the top and bottom of the box.

The front and rear walls 10 and 12 are each provided with a relatively large opening along a preferably curved line which is indicated at 28, and this opening is open to the top of each of the front and rear walls leaving solid portions 30, 30 at each end thereof together with a folded in tab 32, 32. The openings bounded by the curved line 28 also intersect side wall 14 and in effect side wall 14 actually includes the part indicated at 20, the top edge 22 of which is on a level with the top of side wall 16.

Figure 2:
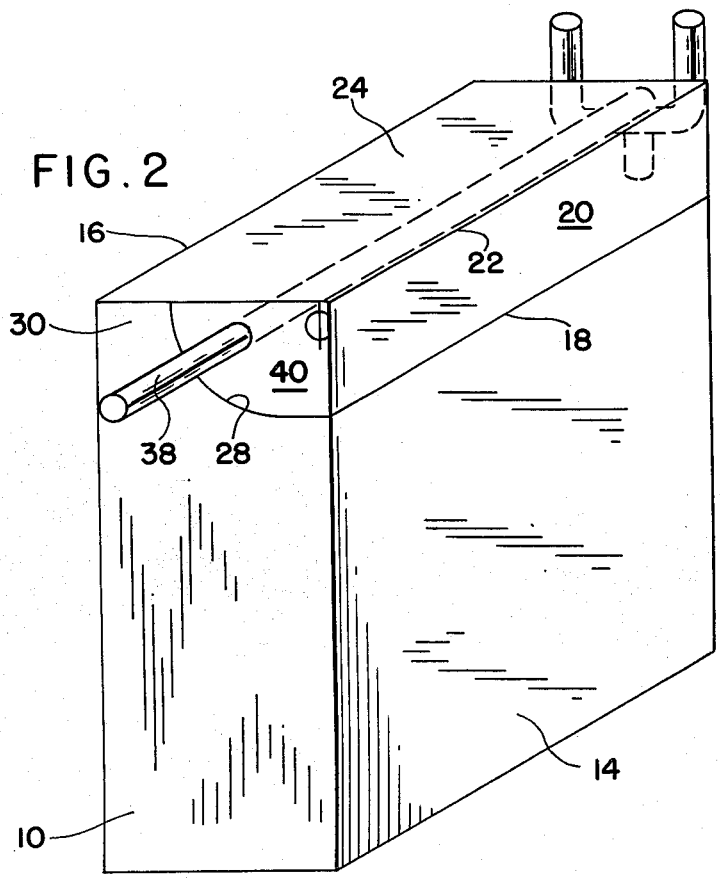
FIG. 2 is a perspective view showing the package closed, with the hanger in place.

These openings in the walls 10 and 12 extend from wall 14 past the centers of the walls 10 and 12 and a comparable distance or approximately so downwardly from the edge 22, see FIG. 2, when the box is closed.

There are a plurality of cards in the package and each of them is provided with a hanger hole 36 for the reception of the hanger 38 by which the entire package as shown in FIG. 2 can be mounted on a perforated board as will be clear to those skilled in the art.

Whether the package is mounted on the perforated board or not, the lid comprising members 20, 24, and 26 is easily opened to the FIG. 1 position, whereupon all of the cards may be imprinted as in the exposed areas 40 for any information as price, etc., which can be applied to each card even though the cards are in place within the box. The box may then be closed and it is now ready for sale of the contents if mounted on a perforated board, but if the pricing information etc., was applied as on a bench or table before mounting on a perforated board, the package comprising the container plus merchandise is now ready to be mounted on the board with the cover closed as shown in FIG. 2.

I claim:

1. A package comprising a box having an open top, a bottom, front and rear walls, a pair of opposite side walls, and a lid for said box, a series of merchandise display cards stacked uprightly in said box in substantially parallel relationship with said front and rear walls, each of said cards having merchandise mounted thereon and being of a length substantially equal to the distance from the bottom to the open top of said box, an aperture in each card, said apertures being aligned at the area of the box adjacent the open top thereof, one of the side walls of said box having an upper side wall portion which is integrally hinged to said one side wall below said open top along a first fold line which is parallel to the top and bottom of said box, said lid including said upper side wall portion, a top member hinged to the top edge of said upper side wall portion along a second fold line parallel to said first fold line for closing said open top, and an end flap hinged to said top member along a third fold line parallel to said second fold line and opposite said upper wall portion, for securing said lid in closed position, said front and rear walls each having an opening therein extending downwardly from said open top and inwardly from said one side wall, said openings providing a corner recess in said front and rear walls adjacent said one side wall which is of a depth along said one side wall substantially equal to the depth of said upper side wall portion between said first and second fold lines and is of a width adjacent said open top sufficient to expose the apertures in said cards, solid portions on each of said front and rear walls along the side of said openings which is opposite said one side wall, said solid portions extending upwardly to said open top and providing support for said top member of said lid in its closed position, said lid being swingable about said first hinge line to close said box by raising said upper side wall portion into substantially the same plane with the remainder of said one side wall, swinging said top member down about said second fold line over said open top and folding said end flap down in adjacent parallel relationship with said side wall opposite said one side wall, said openings when the lid is closed exposing the aligned apertures in said series of cards whereby a hanger rod for said cards may be inserted through said openings and the aligned apertures, said lid alternatively being swingable about said first hinge line to swing the lid outwardly and down below said first hinge line whereby aligned like corners of all of the cards are fully exposed for the application of price markings thereon.

2. The package according to claim 1 wherein each of said solid wall portions has a tab extension hinged thereto along a fold line whereby the tab extension may be folded in over said open top of said box.

* * * * *